US007032710B2

(12) United States Patent
Anderson et al.

(10) Patent No.: US 7,032,710 B2
(45) Date of Patent: Apr. 25, 2006

(54) ANCHOR POINT DEVICES, SYSTEMS AND METHODS FOR USE IN FALL PROTECTION

(75) Inventors: Preston L. Anderson, Seneca, PA (US); Ronald W. Adams, Franklin, PA (US); Steve D. Spotts, Cranberry Township, PA (US); Michael J. Gaydos, Allison Park, PA (US)

(73) Assignee: Bacou-Dalloz Fall Protection, Inc., Franklin, PA (US)

( * ) Notice: Subject to any disclaimer, the term of this patent is extended or adjusted under 35 U.S.C. 154(b) by 0 days.

(21) Appl. No.: 10/100,532

(22) Filed: Mar. 18, 2002

(65) Prior Publication Data

US 2003/0173149 A1 Sep. 18, 2003

(51) Int. Cl.
*E04G 3/28* (2006.01)
*E04G 1/36* (2006.01)
*A62B 1/16* (2006.01)

(52) U.S. Cl. ..... 182/16; 182/3; 182/45

(58) Field of Classification Search ..... 182/3, 182/5, 36, 38, 43, 45, 42, 142, 41, 71, 70, 182/191, 198; 248/13, 16, 208, 237; 104/115; 280/47.18, 47.24
See application file for complete search history.

(56) References Cited

U.S. PATENT DOCUMENTS 2,569,821 A 10/1951 Fredrick
3,159,110 A * 12/1964 Wylie ..... 182/142 X
4,274,507 A * 6/1981 Williams ..... 182/12
4,542,804 A * 9/1985 Power ..... 182/38
4,801,117 A * 1/1989 Take ..... 182/142 X
4,817,758 A * 4/1989 Gilmore ..... 182/142 X
4,852,692 A 8/1989 Flaherty
5,065,838 A * 11/1991 Finley ..... 182/38
5,135,078 A * 8/1992 Bell et al. ..... 182/142
5,219,039 A * 6/1993 Bell ..... 182/3
5,341,898 A * 8/1994 Baziuk ..... 182/142
5,423,398 A * 6/1995 Brown ..... 182/142
5,498,011 A * 3/1996 Kilada et al. ..... 182/142 X
5,622,237 A 4/1997 Moldow
5,771,993 A 6/1998 Anderson
6,006,700 A 12/1999 Cox
6,227,553 B1 * 5/2001 Palmer ..... 182/13 X

FOREIGN PATENT DOCUMENTS

EP 0 395 297 10/1990
WO WO 03/080186 A1 10/2003

* cited by examiner

*Primary Examiner*—Hugh B. Thompson, II
(74) *Attorney, Agent, or Firm*—Bartony & Hare, LLP

(57) ABSTRACT

An anchoring system includes an anchor member to anchor the lifeline and at least one extending unit to extend the anchor member out to a working position beyond (horizontally) and above (vertically) an edge to provide for an overhead anchoring point. The anchoring system preferably further includes a support to which the extending unit is attached. The support immobilizes the overhead anchoring system so that the anchor member remains at the working position (even in the case of a fall by the worker). A method of anchoring a fall protection lifeline for use by a worker working at or beyond an edge includes the steps: elevating an anchor member to position the lifeline above the head of a worker and supporting the anchor member at the working position. The method can also include the step of extending the anchor member to a working position horizontally beyond and above the edge.

31 Claims, 10 Drawing Sheets

ANCHOR POINT DEVICES, SYSTEMS AND METHODS FOR USE IN FALL PROTECTION

BACKGROUND OF THE INVENTION

The present invention relates to anchor point devices, systems and methods for use in fall protection, and, especially, to mobile, overhead anchoring devices, systems and methods for use by personnel working at an edge, for example, the leading edge of a construction project or other structure.

Fall protection systems including safety harnesses and lanyards are commonly used to protect persons subjected to the potential of a fall from a height. Typically, a lifeline or lanyard is connected to an overhead anchorage point on a structure. However, in many cases (for example, leading edge work and work on the highest completed deck of a construction project), suitable overhead fall protection anchorage may not exist.

For example, FIG. 1 illustrates a worker 10 positioned at the leading edge of a portion of a deck of a construction project. In general, in extending the deck in a horizontal direction, lateral I-beams 20 (for example, aluminum I-beams) or other lateral support structures are placed at a predetermined spacing (for example, 16 inches) on beams 30 extending from a more formed or completed section or portion 40 of the decking, and supported by some structure extending to the floor below.

Under current practice, workers such as worker 10 are not anchored via a lifeline when working at a leading edge of a construction project as illustrated in FIG. 1 because there is no suitable anchorage point available. In that regard, as the deck under construction is typically the highest deck of the construction project, there is no suitable overhead anchorage point.

It is possible to "horizontally" anchor worker 10 to an anchorage point A positioned generally horizontally or laterally from worker 10 on a completed portion of the decking via a generally horizontally extending lifeline or lanyard 50 which can be part of a retractable lanyard system 60 (see, for example, U.S. Pat. No. 5,771,993, the disclosure of which is incorporated herein by reference). An example of a commercially available, retractable lanyard is the MILLER MIGHTYLITE self-retracting lifeline, available from Dalloz Fall Protection of Franklin, Pa. Retractable lanyard systems such as retractable lanyard system 60 typically include a breaking mechanism (not shown in FIG. 1) to arrest the fall of a mass or person attached thereto once an internal, tensioned drum (not shown in FIG. 1) reaches a predetermine angular velocity (corresponding to a certain rate of fall). The drum of self-retractable lanyard system 60 is preferably is under adequate rotational tension (provided, for example, by a spring) to reel up excess extended lifeline 50 without hindering the mobility of the user 10. Lanyard 50 can, for example, be connected to a D-ring 70 of a safety harness 80 worn by worker 10.

Although a lifeline anchorage as illustrated in FIG. 1 may provide some level of protection for construction workers working on the leading edge of deck placement or working on the highest completed deck of a construction project, workers falling from the edge of a deck who are tied off to such a lifeline anchorage can suffer injuries if, for example, they swing during or after the fall or if they strike a lower deck or structure extending to the floor below. For example, the worker can be in free fall until at least that time when lanyard 50 falls a distance X to contact the edge of forward beam 20. In general, only after lanyard 50 contacts beam 20 will the drum of retractable lanyard system experience an angular velocity corresponding to the rate of fall. The fall of worker 10 may not, therefore, be arrested before worker 10 strikes something below. In that regard, lower decks are often only approximately eight to twelve feet below an upper deck under construction. Moreover, with or without use of retractable lanyard system 60, worker 10 can swing into an obstruction during the fall or after the fall has been arrested. The worker could also strike the support structure for beams 30. Non-retracting lanyards can be substituted for retractable lanyards, but non-retracting lanyards tend to either limit the mobility of the worker, or allow excessive free fall that is more likely to cause a strike on structure below the work surface.

It is desirable, therefore, to develop devices, systems and methods that reduce or eliminate the above problems.

SUMMARY OF THE INVENTION

In one aspect, the present invention provides an anchoring system including an anchor member to anchor a lifeline and at least one extending unit to extend the anchor member out to a working position beyond (horizontally) and above (vertically) an edge to provide for an overhead anchoring point. The anchoring system preferably further includes a support to which the extending unit is attached. The support immobilizes the overhead anchoring system so that the anchor member remains at the working position (even in the case of a fall by the worker).

The extending unit can, for example, include at least two extending members and the anchor member can extend between the two extending members. The anchor member can be of sufficient length to accommodate the lifelines of a plurality of workers. The support can, for example, include an attachment member (for example, a clamp) to fix the anchoring system in a desired position. At least one counterweight can be in operative connection with the support to, for example, prevent tipping of the anchoring system.

The support can, for example, include wheels for transport of the anchoring system. Preferably, such a mobile systems includes an immobilizer to fix the anchoring system in a desired position. The immobilizer can, for example, includes at least one jack in operative connection with the support to remove at least part of the weight of the support from at least one of the wheels of the support. In one embodiment, the support rests on a pallet jack to move the anchoring system and to fix the position of the anchoring system. The immobilizer can also include at least one abutment member that abuts a surface of the structure. Alternatively, the immobilizer can include at least one braking unit on at least one of the wheels.

In one embodiment, the extending unit includes at least one horizontally extending member to extend the anchor member out to the working position and at least one generally vertically extending member to which the horizontally extending member is attached to elevate the anchor member to the working position.

At least one handle can be attached to a mobile support to accommodate manual movement of the anchoring system. The anchoring system can also include lifting attachments to lift the system to a location. The anchoring system can be made to be disassembled for storage or transport. In case of disassembly, each component of the anchoring system can include lifting attachments to facilitate lifting of the system to a location.

The system can further include a lifeline and a harness to be worn by the worker. The harness is connectible to the lifeline (via, for example, a D-ring as known in the art). The system can further include a self-retractable lanyard system in which the lifeline is in operative connection.

In another aspect, the present invention provides an anchoring system for use in fall protection including an anchor member to anchor a lifeline and at least one extending unit to extend the anchor member to a working position vertically above an edge of a work area to provide for an anchoring point vertically higher than a worker's head. The anchoring system also includes a support to which the extending unit is attached. The support immobilizes the overhead anchoring system so that the anchor member remains at the working position.

In still a further aspect, the present invention provides a method of anchoring a fall protection lifeline for use by a worker working at or beyond an edge. The method includes the steps of elevating an anchor member to position the lifeline above the head of a worker and supporting the anchor member at the working position. The method can also include the step of extending the anchor member to a working position horizontally beyond and above the edge.

The present invention thus provides devices, systems and methods for anchoring a lifeline for use in fall protection to an overhead anchor member in situations in which an overhead anchorage is not otherwise available. The anchoring devices and systems of the present invention can, for example, be positioned at the leading edge of a roof or a deck construction, or any unguarded edge, to provide overhead support.

The systems and methods of the present invention greatly increase the fall protection for a worker at the leading edge or the top deck of a structure by providing an overhead anchorage for the worker's lifeline. In general, the present invention is preferably mobile so that it can be positioned in the most favorable location on, for example, a roof or a deck to give a worker an optimal overhead anchorage point.

DETAILED DESCRIPTION OF THE INVENTION

Figure 1:
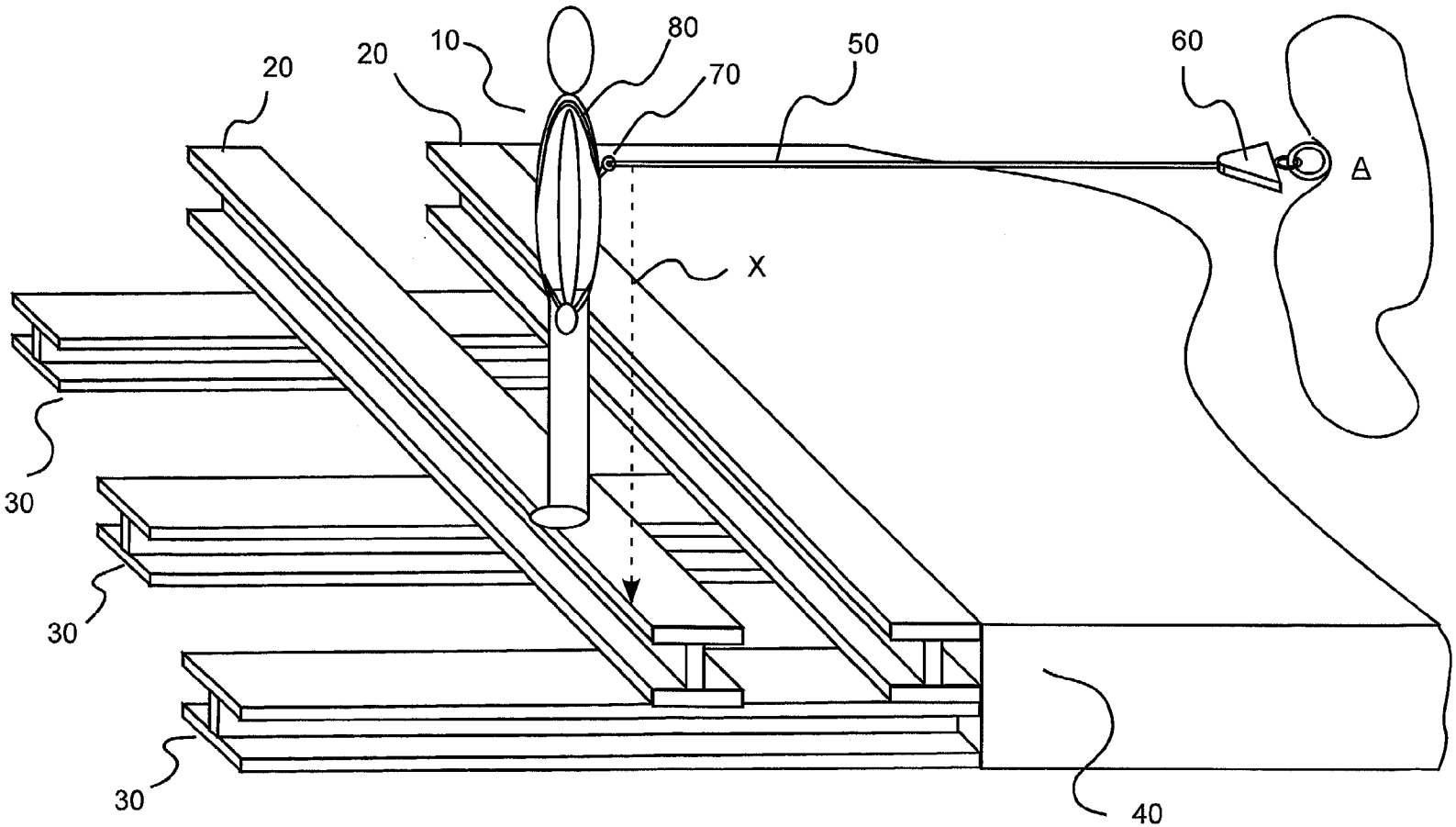
FIG. 1 illustrates a perspective view of worker on the leading edge of a portion of a deck under construction in which the worker is connected to a generally horizontal lifeline anchorage.

In the embodiment illustrated in FIGS. 2 through 5F, the present invention provides an overhead anchoring device or system 100 that includes an anchor member 105 attached to one end of a generally horizontally extending member 110. In the embodiment of FIGS. 2–5F, horizontal extending member 110 includes a first generally horizontal member 112 to which two extending member 114*a* and 114*b* are attached at generally opposing angles in the form of a "Y". Anchor member 105, in this embodiment, is a transverse bar extending between the forward end of extending members 114*a* and 114*b*. Anchor member 105 can, alternatively, be attached directly to a horizontal extending member such as generally horizontal member 112 in the general form of a "T".

As used herein, the term "forward" refers to a direction toward the anchor member of the anchoring devices or systems of the present invention. The term "rearward": refers to an opposite direction, away from the anchor member.

Generally horizontal extending member 110 is attached at its rearward end to the elevated end of generally vertically extending member 120. The opposite and lower end of vertically extending member 120 is attached to the front end of a support 130. Weighted members 140 are preferably positioned at the rear end of support 130 to provide a counterweight to prevent overhead anchoring system 100 from tipping forward when a load (for example a person suspended by a lifeline) is applied to anchor member 105 through, for example, a lifeline 50 attached to D-ring 70 of safety harness 80 as worn by a worker 10 (see FIG. 3). An example of a safety harness suitable for use in connection with the anchoring systems of the present invention is described in U.S. Pat. No. 6,006,700, the disclosure of which is incorporated herein by reference.

Figure 2:
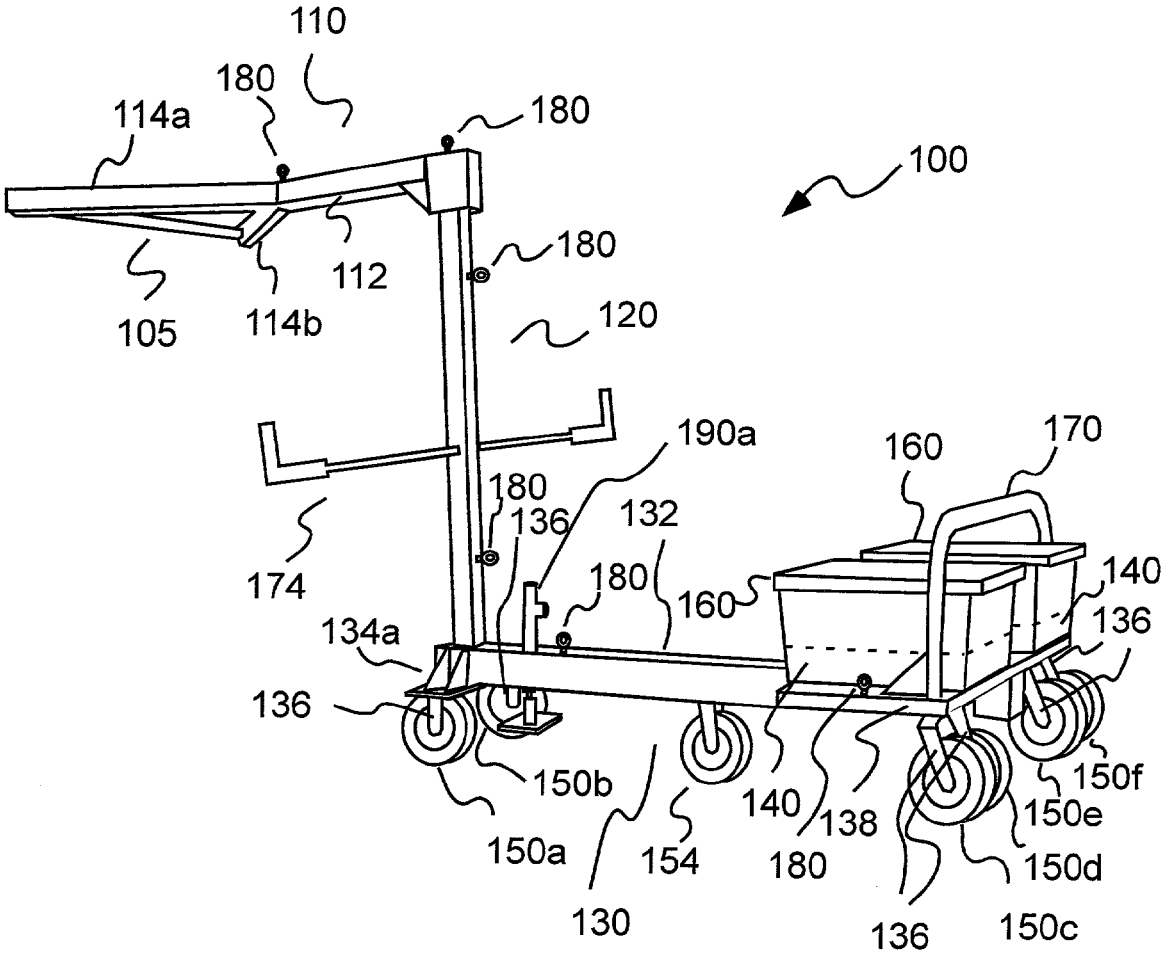
FIG. 2 illustrates a perspective view of one embodiment of an overhead anchoring system of the present invention.
Figure 3:
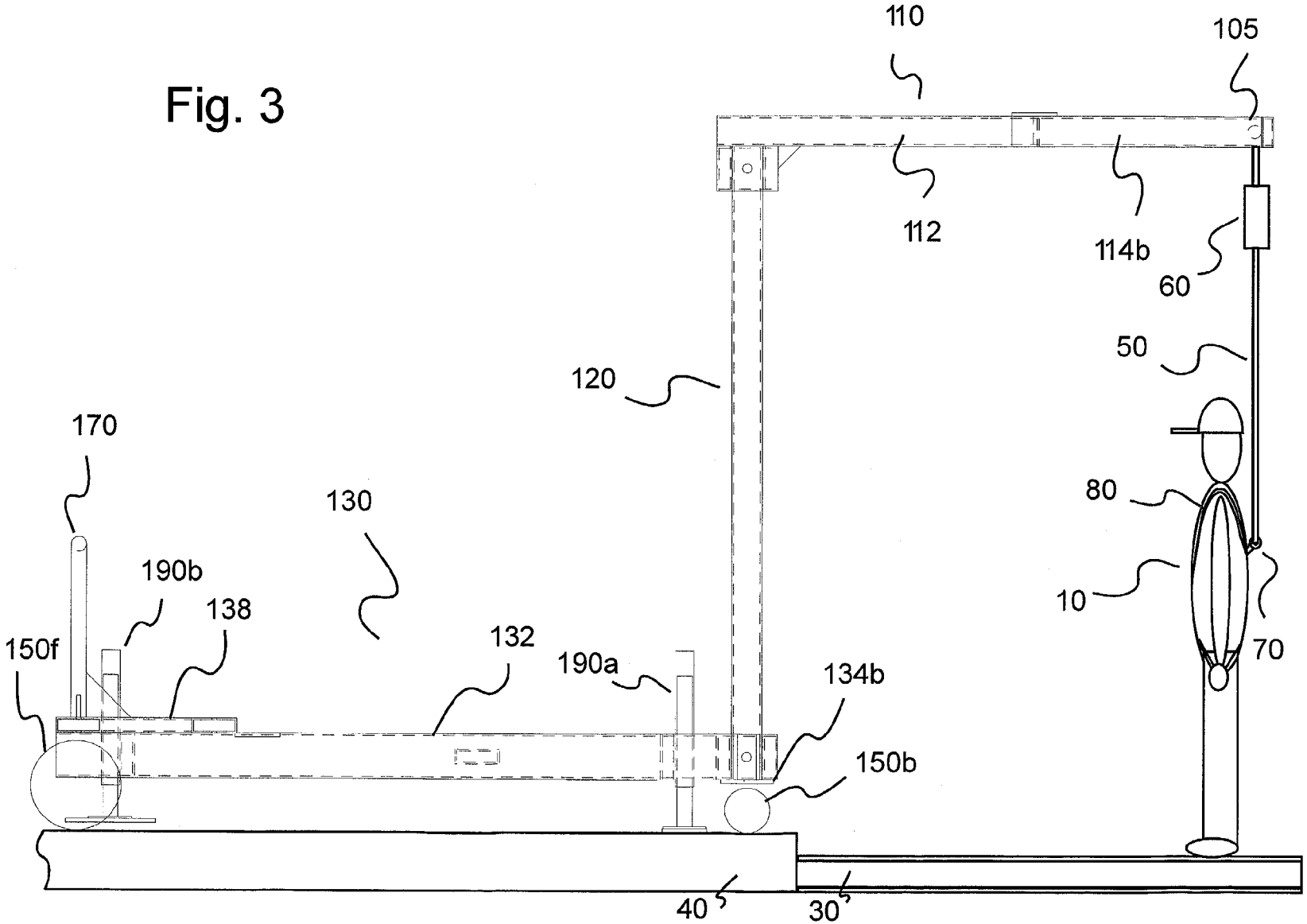
FIG. 3 illustrates a side view of the anchoring system of FIG. 2.
Figure 4:
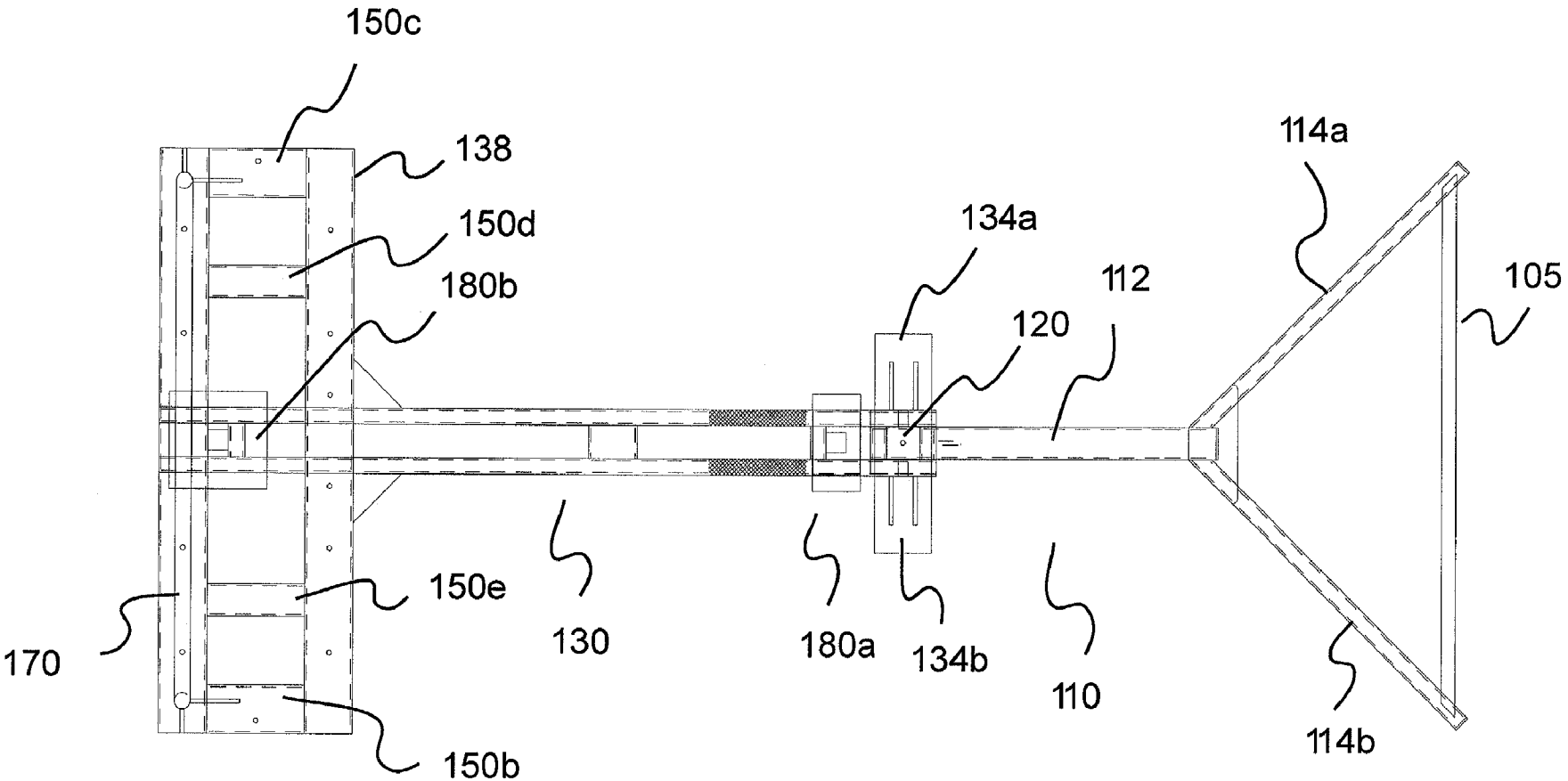
FIG. 4 illustrates a top view of the anchoring system of FIG. 2 showing one configuration of an anchor member that can accommodate two lifelines.
Figure 5D:
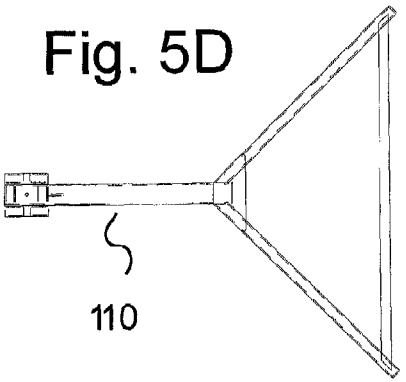
FIG. 5D illustrates a top view of the generally horizontal extending member of FIG. 5C.
Figure 5C:
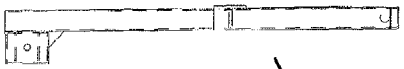
FIG. 5C illustrates a side view the generally horizontal extending member of the anchoring system of FIG. 2 disconnected from the other components thereof.
Figure 5B:
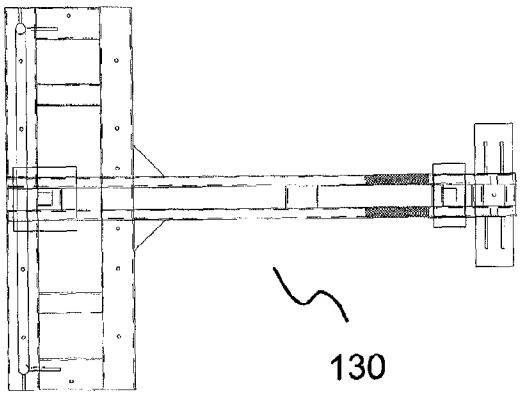
FIG. 5B illustrates a top view of the support of FIG. 5A.
Figure 5A:
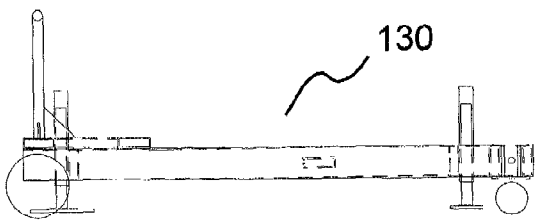
FIG. 5A illustrates a side view of the support of the anchoring system of FIG. 2 disconnected from the other components thereof.
Figure 5E:
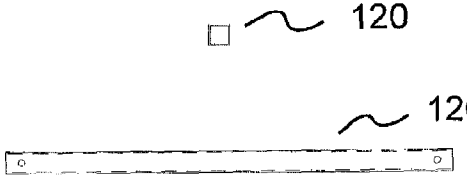
FIG. 5E illustrates a side view of the generally vertical extending member of the anchoring system of FIG. 2 disconnected from the other components thereof.
Figure 5F:
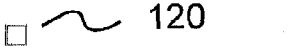
FIG. 5F illustrates a top view of the generally vertical extending member of the anchoring system of FIG. 5E.

As further illustrated, for example, in FIGS. 2 and 3, a plurality of wheels 150*a*–*f* (six in this embodiment), can be mounted to the bottom of support 130 to make overhead anchoring system 100 mobile. In that regard, support 130 includes a generally longitudinal base 132 (for example, a steel beam) to which front wheel support members 134*a* and 134*b* are attached. Wheel brackets 136 extend downward from support members 134*a* and 134*b* to attach wheels 150*a* and 150*b*.

Support 130 also includes a rear platform 138. Wheel brackets 136 extend downward from platform 138 to attach wheels 150*c*–*f*. A swivel caster 154 (see FIG. 2) can be provided at approximately the center of base 132 so that, for example, if wheels 150*a* and 150*b* move over a hole or edge in a surface over which anchoring system 100 is being transported, wheels 150*a* and 150*b* will not fall into that hole.

Platform 138 can, for example, support one or more containers 160 in which counter weights 140 (for example, steel plates or concrete) are positioned.

Containers 160 can, for example, be fabricated from plastic and can be removable from platform 138. In FIGS. 3, 4, 5A and 5B, containers 160 have been removed. Containers 160, can, for example, be replaced with steel plates or other counterweights 140 placed on, bolted on or welded to platform 138. Containers 160 can be open on the top thereof to provide for removal of or addition of weighted members 140.

Attached to and extending up from support 130 of the embodiment illustrated in FIGS. 2 through 5F is a rearward handle 170 to facilitate manual movement of overhead anchoring system 100. A second, forward handle 174 can, for example, be provided on vertical extending member 120 to facilitate maneuvering of the front of anchoring system 100.

As illustrated in FIG. 2, overhead anchoring system 100 preferably can also be moved or lifted by, for example, a crane by rigging overhead anchoring system 100 through one or more lifting attachments 180 mounted on overhead anchoring system 100. A plurality of lifting attachments 180 (for example, I-bolts) can be provided for a balanced lift of entire system 100 or of individual components thereof. If, for example, positioned at the center of gravity, a single lifting attachment can be used.

As illustrated, for example, in FIGS. 5A through 5F, each of horizontal extending member 110, vertical extending member 120 and support 130 preferably can be disassembled to facilitate lifting or other transporting thereof into position on, for example, an upper deck of a construction project. Each disassembled component (for example, horizontal extending member 110, vertical extending member 120 and support 130) of an anchoring system of the present invention can include one or more lifting attachments 180 (see FIG. 2). Although multiple lifting attachments 180 are illustrated on each of horizontal extending member 110, vertical extending member 120 and support 130, a single lifting attachment 180 can provide a balanced lift for each such disassembled component if positioned at or near the center of gravity thereof.

Once positioned on a desired deck, horizontal extending member 110, vertical extending member 120 and support 130 can be assembled using, for example, connectors such a bolts as known in the art. Wheels 150*a* through 150*f* then facilitate movement of assembled anchor system 100 to the leading edge of, for example, deck 40 so that horizontal member 110 extends over the leading edge of the construction (see, for example, FIG. 3).

Preferably, anchoring system 100 is immobilized or fixed in position once placed at the leading edge of the construction as illustrated, for example, in FIG. 3. Anchoring system 100, for example, includes one or more jacks 190*a* and 190*b*. The base of each of jacks 190*a* and 190*b* can be lowered to remove at least part of the weight of anchoring system 100 from one or more of wheels 150*a–f*. In FIG. 3, the base of forward jack 190*a* has been lowered to contact formed decking 40, while the base of rearward jack 190*b* remains elevated above deck 40. The weight of anchoring system 100 and friction between the bases of jacks 190*a* and 190*b* and deck 40 prevent movement of anchoring system 100 when one or more workers 10 is anchored to anchor member 105, or experience a fall.

Figure 6:
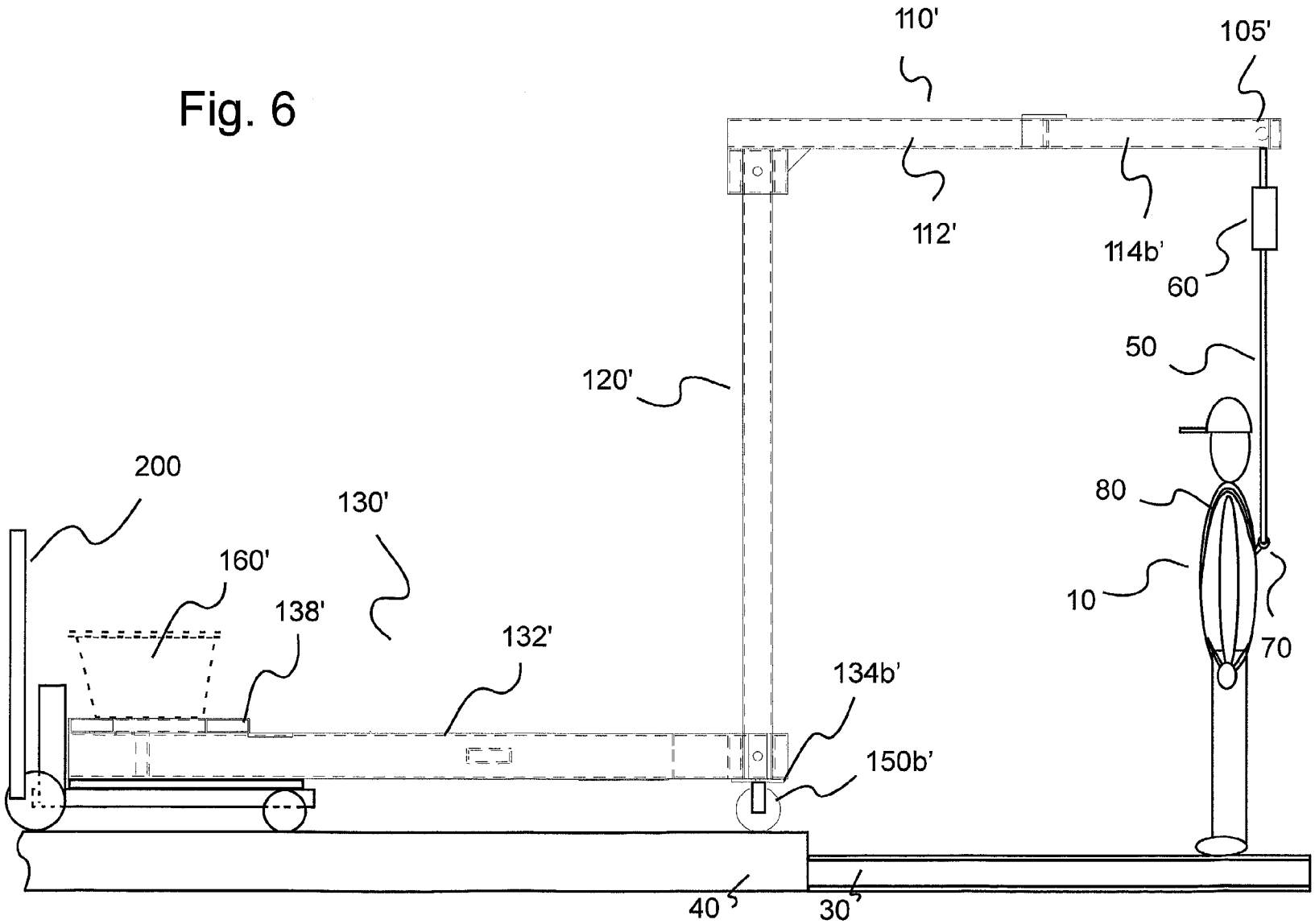
FIG. 6 illustrates a side view of another embodiment of an anchoring system of the present invention including a support having a pallet jack to mobilize the anchoring system and to immobilize or fix the anchoring system in place.

FIG. 6 illustrates another embodiment of overhead anchoring system 100' similar in operation to anchoring system 100. In the case of anchoring system 100', however, 130' is designed and sized to rest upon the forks of a fork lift or upon a pallet jack 200 as known in the art to mobilize anchoring system 100 and to immobilize or fix anchoring system 100' at a desired position. Like components of anchoring system 100' are numbered similarly to corresponding components of anchoring system 100 with the addition of a "'" designation. However, rear transverse member or platform 138 can include, for example, weighted members such a steel beams that act as counterweight(s), thereby removing the need for a container 160' (illustrated in dashed lines in FIG. 6) for holding such counterweights. One or more such containers can be included, however, to facilitate increasing the amount of counterweight. The mobility of overhead anchoring system 100 or anchoring system 200 can be automated or facilitated by adding a powered device or drive to one or more of the wheels thereof.

To facilitate the assembly and disassembly of overhead anchoring system 100 for storage and transport, the attachment of horizontally extending member 110 to the elevated end of vertically extending member 120 and the attachment of the opposite and lower end of vertically extending member 120 to support 130 can be made with bolts or other attachment devices as described above that can be taken apart by workers using traditional and readily available construction tools such as wrenches. Alternatively, attachment points can be loosened so that, for example, horizontally extended member 110 can fold back on vertically extended member 120, which in turn can fold back on support 130.

A pivoting joint can be incorporated between horizontally extending member 110 and vertically extending member 120 and/or between vertically extending member 120 and support 130 to allow a worker to turn anchor member 105 up to, for example, 360 degrees. Horizontally extending member 110 can also be made extendible (for example, by allowing member 112 and/or members 114*a* and 114*b* to telescope) to increase or decrease the reach of overhead anchoring system 100. Base 132 of support 130 can also be extendible, for example, by telescoping steel member. In cases that horizontal extending member 110 is extended forward, it may be desirable to extend base 132 in a rearward direction to increase the lever arm associated with counterweight(s) 140. Vertically extending member 120 can also be made extendible to adjust the height of anchor member 105, for example, via telescoping as known in the art.

Figure 7:
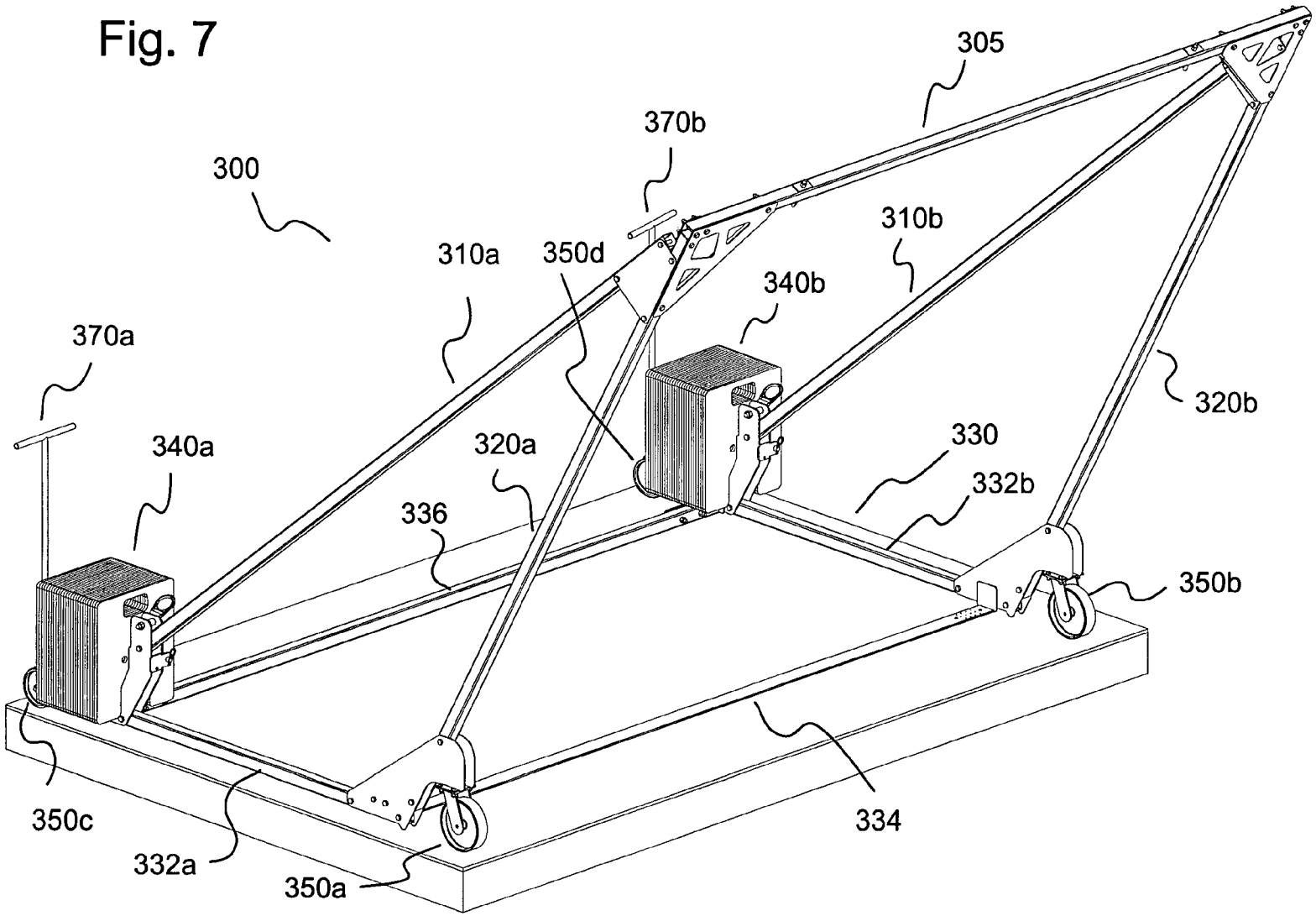
FIG. 7 illustrates a perspective view of another embodiment of an anchoring system of the present invention.
Figure 8:
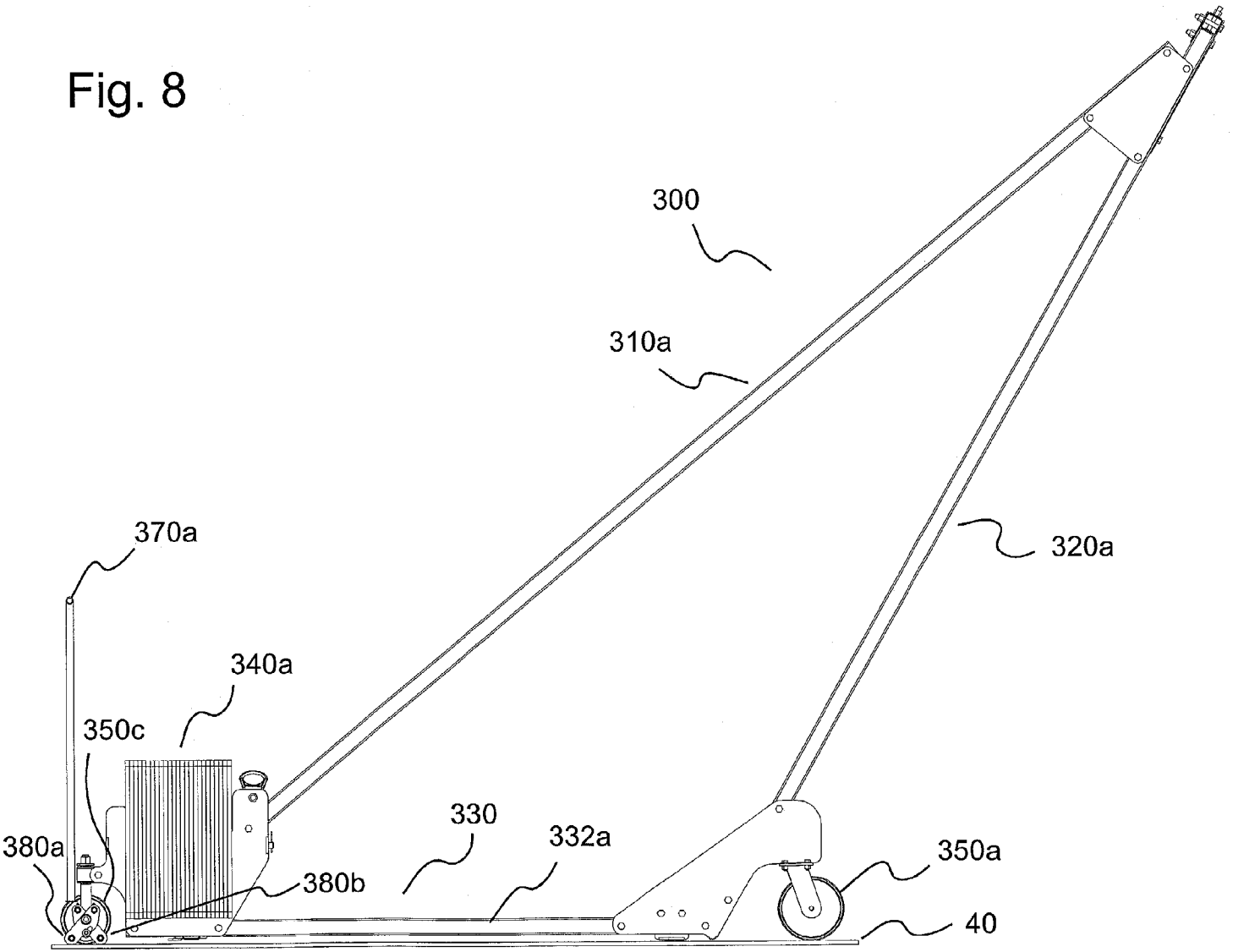
FIG. 8 illustrates a side view of the anchoring system of FIG. 7 in which a breaking system is engaged to fix the anchoring system in place.
Figure 9:
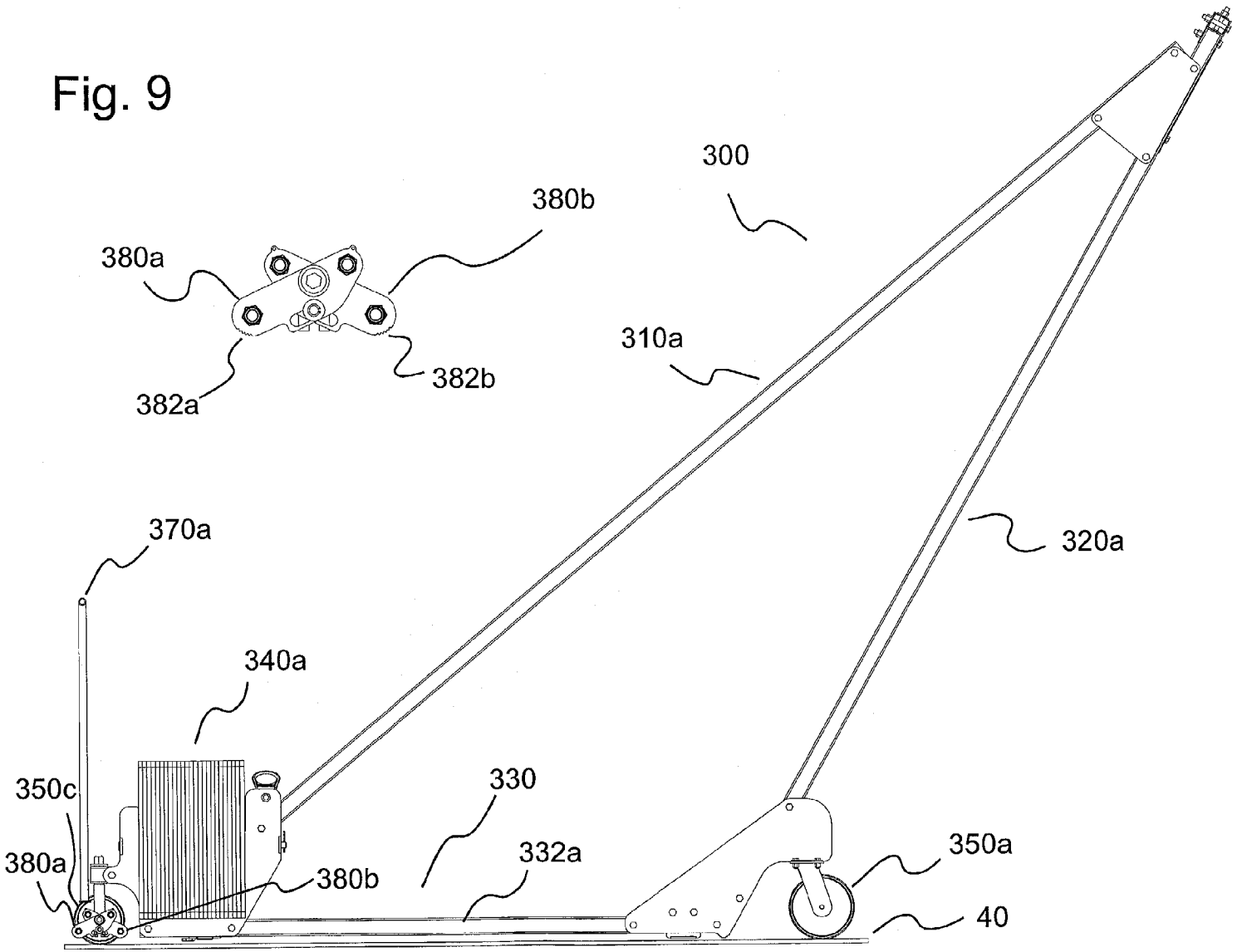
FIG. 9 illustrates a side view of the anchoring system of FIG. 7 in which the breading system is disengaged to mobilize the anchoring system.

Another embodiment of an anchoring system 300 is illustrated in FIGS. 7 through 9. In anchoring system 300, an anchor member 305 is supported beyond the leading edge of, for example, formed decking 40 and above a worker by a plurality of angled extending members 310*a*, 320*a*, 310*b* and 320*b*. Extending members 310*a* and 320*a* from a first angled A-frame, while extending members 310*b* and 320*b* form a second angled A-frame.

Each of angled extending members 310*a*, 320*a*, 310*b* and 320*b* is attached to a support 330, which rests upon a surface such as deck 40. In the embodiment of FIGS. 7 through 9, support 330 of anchoring system 300 includes a first longitudinal member 332*a* and a second longitudinal member 332*b* in spaced connection via a forward transverse member 334 and a rear transverse member 336. Two counterweight systems or units 340*a* and 340*b* are provided upon a rearward end of support 330. In the embodiment of FIGS. 7 through 9, counterweight units 340*a* and 340*b* include a plurality of steel plates. Support 330 also includes wheels 350*a–d* as described above in connection with anchoring system 300. In this embodiment, wheels 350*c* and 350*d* are double-wheel sets. Support 330 further includes handles 370*a* and 370*b* to facilitate maneuvering of anchoring system 300 during transport thereof.

Like anchoring systems 100 and 100', anchoring system 300 includes an immobilizer to fix anchoring system 300 in a desired position and to prevent movement thereof. In that regard, anchoring system 300 includes braking arms 380*a* and 380*b* on each of the assemblies of wheel sets 350*c* and 350*d*. In FIGS. 8 and 9, the outside wheel of back wheel set or pair 350*c* has been removed to show braking arms 380*a*, and 380*b*. As clear to one skilled in the art, positioning the breaking mechanism so that it rotates with the wheels as illustrated in FIGS. 8 and 9, facilitates braking operation by ensuring that the maximum braking force is generally aligned with the wheels.

Breaking arms 380*a* and 380*b* move in the manner of scissor arms to be brought into fixed abutment with a surface such a deck 40 (see FIG. 8) to immobilize anchoring system 300 and to be removed from contact with a surface such as deck 40 (see FIG. 9) to allow movement of anchoring system 300 thereover via wheels 350*a–d*. As illustrated in FIG. 9, each of breaking arms 380*a* and 380*b* can include a serrated section 382*a* and 382*b*, respectively, to improve the braking aspect thereof. Such serrated sections can, for example, dig into a wooden or other deformable or roughened surface.

The open nature of support 330 allows a worker to walk therethrough (between weighting units 340*a* and 340*b* and over transverse member 336 and 334) to reach the leading edges of deck 40 to, for example, facilitate the transfer of materials to the work area.

Figure 10:
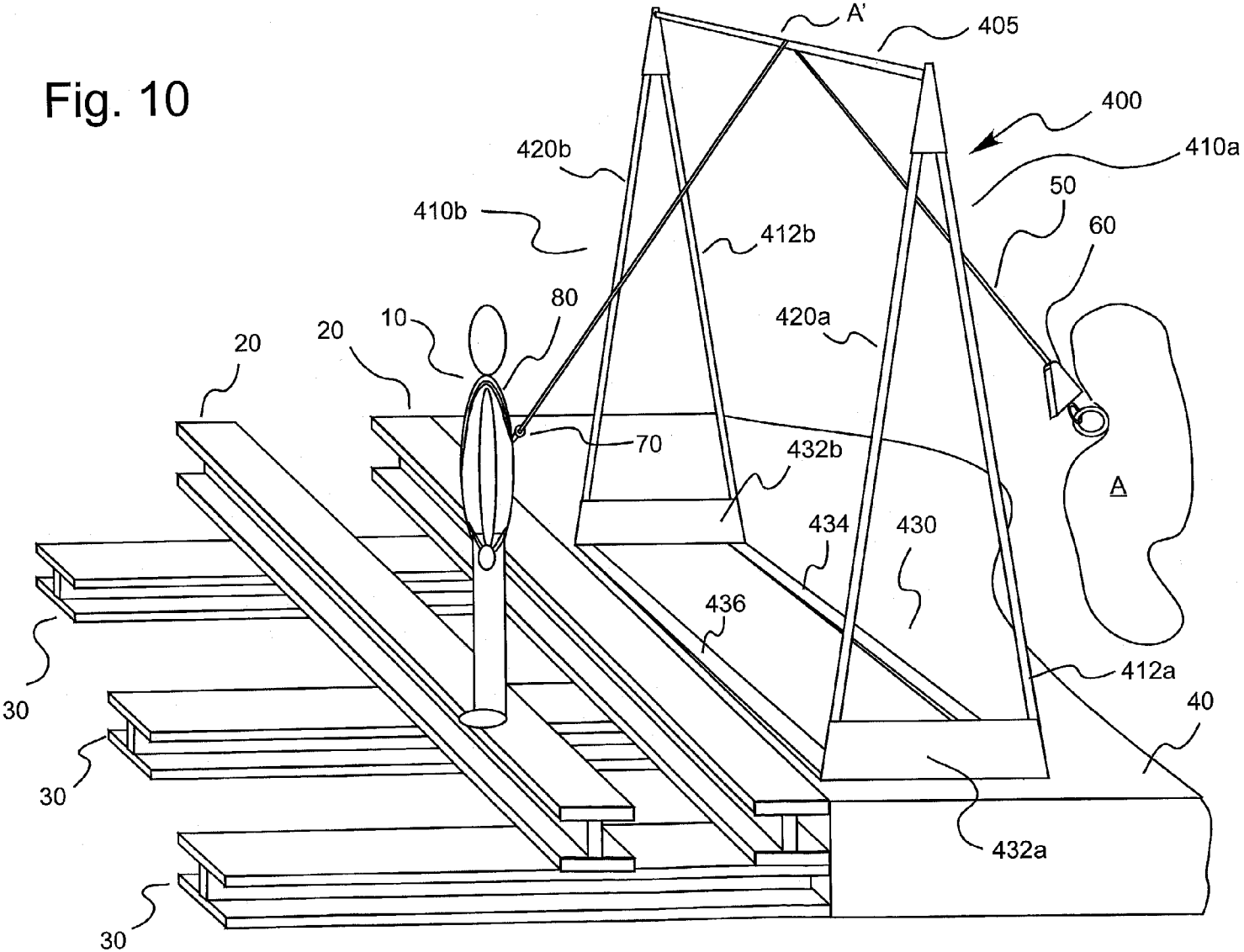
FIG. 10 illustrates a perspective view of another embodiment of an anchoring system of the present invention.

FIG. 10 illustrates another embodiment of an anchoring system 400 of the present invention. Unlike anchoring systems 100, 100' and 300, anchor member 405 of anchoring system 400 is not extended beyond the edge of the work area. In that regard, anchoring system 400 includes two generally vertically extending supports 410*a* and 410*b*. Anchor member 405 (for example, a steel bar) extends between vertically extending supports 410*a* and 410*b* at or near the elevated end thereof. In the embodiment of FIG. 10, vertically extending supports 410*a* and 410*b* include extending members 412*a* and 420*a* and extending members 412*b* and 420*b*, respectively, connected generally in the form of A-frames. Anchoring system 400 can also include a support or base 430, which can include generally longitudinal member 432*a* and 432*b* connected between extending members 412*a* and 420*a* and extending members 412*b* and 420*b*, respectively. Base 430 can also include generally latitudinal or transverse members 434 and 436 connected between generally longitudinal member 432*a* and 432*b*.

Although it is desirable that an anchor point be located above the head of worker 10 as well as generally in line vertically with worker 10, the present inventors have discovered that it is beneficial to have an effective anchor point positioned in the vicinity of an edge of a work area as high as possible (preferably above the head of worker 10) even if that anchor point is not generally vertically aligned with worker 10. As used herein, the term "effective anchor point" refers generally to the anchor point experienced by worker 10, which need not be the same point to which a lanyard or lifeline 60 supporting worker 10 is attached. In FIG. 10, for example, self-retractable lanyard 60 is connected to anchor A, which can be any stable anchor member such as a column or heavy weight. As discussed in connection with FIG. 1, anchor A is positioned generally laterally or horizontally with respect to D-ring 70 of harness 80 worn by worker 10. However, in the system of FIG. 10, lanyard 50 passes over anchor member 405, creating an effective anchor point or height A'. Self-retractable lanyard 60 or other lifeline system can also be anchored directly to anchor member 405.

Should worker 10 fall, the drum of self-retractable lanyard 60 will much more quickly experience an angular velocity corresponding to the rate of fall of worker 10 than is the case with the system of FIG. 1, thereby stopping the fall of worker 10 more quickly. Although, worker 10 can still swing during or after a fall, the rate of descent and the vertical length of the fall will be decreased as compared to the system of FIG. 1, thereby reducing the risk of injury. Preferably, anchoring system 400 is placed as close to worker 10 (that is, as close to the edge of deck 40 as possible. Moreover, the higher anchor member 10 is above the head of worker 10, the greater the protection afforded. Preferably, for example, anchor member 405 is 6 to 12 feet above the head of worker 10.

Anchoring system 400 can be fabricated to be fairly light and readily and manually movable, for example, by two workers. Support 430 can also include wheels and an immobilizing or breaking system as described above for anchoring systems 100, 100' and 300. Similar to anchoring system 300, the open nature of anchoring system 400 allows a worker to walk therethrough (between weighting supports 410*a* and 410*b* and over transverse member 434 and 436) to reach the edge of a work area (for example, the leading edge of deck 40) to, for example, facilitate the transfer of materials to the work area.

Although the present invention has been described in detail in connection with the above examples, it is to be understood that such detail is solely for that purpose and that variations can be made by those skilled in the art without departing from the spirit of the invention except as it may be limited by the following claims.

What is claimed is:

1. A system for anchoring at least two lifelines for use in fall protection of persons working forward of the edge of a surface to extend the edge of the surface, comprising: a support and an extending unit in operative connection to the support and adapted to extend out to a forward position forward of an edge and above the head of the person working forward of the edge and standing on a plane having a height such that the plane is generally parallel to or above the surface, the extending unit comprising at least two forward extending members, the system further comprising an anchor member adapted to anchor the lifelines, the anchor member comprising at least one generally horizontal extending member attached to the two forward extending members and extending between the two forward extending members at an angle traverse to the forward extending members, the support adapted to be in operative connection with the surface and maintaining the anchor member at the working position.

2. The system of claim 1 further comprising at least one counterweight in operative connection with the support.

3. The system of claim 2 wherein the support is a mobile support and comprises wheels for transport of the anchoring system, the mobile support further comprising a releasable immobilizer to fix the mobile support at a desired position on the surface.

4. The system of claim 3 wherein the immobilizer comprises a brake system on at least one of the wheels.

5. The system of claim 1 wherein the support comprises an attachment member to fix the anchoring system in a desired position.

6. The system of claim 1 wherein the extending unit comprises at least one generally horizontally extending member to which the two forward extending members are attached to extend the anchor member out to the working position and at least one generally vertically extending member to which the horizontally extending member is attached to elevate the anchor member to the working position.

7. The system of claim 6 wherein the support is mobile.

8. The system of claim 7 wherein the support includes a plurality of wheels.

9. The system of claim 7 wherein the support includes at least one counterweight to offset the weight of at least one worker anchored to the anchor member via a lifeline.

10. The system of claim 9 wherein the support includes an inimobilizer to fix the position of the anchoring system.

11. The system of claim 10 wherein the immobilizer includes at least one jack in operative connection with the support to remove at least part of the weight of the support from at least one of the wheels.

12. The system of claim 10 wherein the immobilizer includes at least one abutment member that is adapted to abut the surface.

13. The system of claim 9 wherein the immobilizer includes at least one braking unit on at least one of the wheels.

14. The system of claim 6 wherein at least one handle is attached to the support to accommodate manual movement of the anchoring system.

15. The system of claim 6 wherein the support is adapted to rest on a pallet jack to move the anchoring system and to fix the position of the anchoring system.

16. The system of claim 6 further including lifting attachments to lift the system to a location.

17. The system of claim 6 wherein the anchoring member can accommodate a plurality workers.

18. The system of claim 6 wherein the anchoring system can be disassembled for storage or transport.

19. The system of claim 6 further including at least one of a first pivot between the generally horizontally extending member and the vertical member and a second pivot between the vertical member and the support to allow pivoting of the anchor member.

20. The system of claim 19 wherein the generally horizontally extending member is extendible.

21. The system of claim 6 wherein the generally horizontally extending member is extendible.

22. The system of claim 1 further including lifting attachments to lift the system to a location.

23. The system of claim 1 further comprising at least one lifeline to which the worker is attachable.

24. The system of claim 23 further comprising a harness to be worn by the worker.

25. The system of claim 23 further comprising a self-retractable lanyard system in which the lifeline is in operative connection.

26. A system for anchoring at least two lifelines for use in fall protection, comprising: an anchor member to anchor the lifelines, the anchor member comprising at least one generally horizontal laterally extending member over the length of which the at least two lifelines, each lifeline for use by a different worker, are attachable at different horizontal positions, at least one extending unit to extend the anchor member to a working position beyond the edge of a work area and vertically above the edge of the work area to provide for an anchoring point vertically higher than a worker's head, the extending unit comprising at least two extending members and the laterally extending member extending between the two extending members at an angle traverse to the extending unit, and a support to which the extending unit is attached, the support immobilizing the overhead anchoring system so that the anchor member remains at the working position.

27. The system of claim 26 wherein the support is adapted to be place in the vicinity of the edge of the work area.

28. The system of claim 26 further comprising at least one lifeline to which the worker is attachable.

29. The system of claim 26 further comprising at least one harness to be worn by the worker.

30. The system of claim 26 further comprising at least one self-retractable lanyard system in which the lifeline is in operative connection.

31. The system of claim 30 wherein the self-retractable lanyard is adapted to be anchored to an anchor point to the rear of the worker and wherein in the anchor member is adapted so that the lifeline extends up and over the anchor member before attachment to the worker.

* * * * *